US005671604A

United States Patent [19]

Rudick

[11] Patent Number: 5,671,604

[45] Date of Patent: Sep. 30, 1997

[54] APPARATUS FOR ICING A PACKAGE

[75] Inventor: Arthur G. Rudick, Atlanta, Ga.

[73] Assignee: The Coca-Cola Company, Atlanta, Ga.

[21] Appl. No.: 589,659

[22] Filed: Jan. 22, 1996

[51] Int. Cl.[6] ..... F25D 13/06

[52] U.S. Cl. ..... 62/52.1; 62/63; 62/374; 62/384

[58] Field of Search ..... 62/52.1, 62, 63, 62/139, 373, 374, 386, 378, 380

[56] References Cited

U.S. PATENT DOCUMENTS

| | | | |
|---|---|---|---|
| 2,093,410 | 9/1937 | Boon | 221/113 |
| 3,173,273 | 3/1965 | Fulton | 62/5 |
| 3,373,579 | 3/1968 | Federighi | 62/293 |
| 3,373,580 | 3/1968 | Federighi | 62/293 |
| 3,383,879 | 5/1968 | Tice | 62/293 |
| 3,407,624 | 10/1968 | Taylor | 62/293 |
| 3,431,749 | 3/1969 | Bounds et al. | 62/293 |
| 3,602,008 | 8/1971 | Kelley | 62/373 |
| 3,668,888 | 6/1972 | Roslonski | 62/373 |
| 4,237,697 | 12/1980 | Cherbland | 62/293 |
| 4,483,459 | 11/1984 | Taylor | 221/14 |
| 4,676,074 | 6/1987 | Morgan, Jr. et al. | 62/277 |
| 4,986,441 | 1/1991 | Kanbe et al. | 221/130 |
| 5,331,817 | 7/1994 | Anthony | 62/5 |

FOREIGN PATENT DOCUMENTS

| | | |
|---|---|---|
| 1253090 | 10/1989 | Japan . |
| 39495 | 1/1991 | Japan . |
| 3226898 | 10/1991 | Japan . |
| 4188295 | 7/1992 | Japan . |
| 5151443 | 6/1993 | Japan . |
| 438916 | 11/1935 | United Kingdom . |

*Primary Examiner*—Ronald C. Capossela
*Assistant Examiner*—Pamela A. O'Connor

[57] ABSTRACT

An icing system for a beverage package includes a platform for supporting a container for the package to be iced, a liquid spray nozzle(s) for applying a mist or coating of water droplets to the container, a refrigeration unit for freezing the water droplets on the exterior of the container and a delivery station for presenting an iced package beverage to a customer for consumption. In one embodiment, the entire icing system is contained within a cabinet of a vending machine and preferably the front door thereof. In this embodiment, a can orienting funnel is provided in communication with a gravity feed vent chute within the vending machine cabinet to receive and orient the container on the platform. A linear actuator or elevator coupled to the container supporting platform is provided to move the container seriatim past the spray nozzle(s) and refrigeration unit to the delivery station. A stand-alone system could also be provided in another embodiment outside of a vending machine, such as adjacent to a post-mix beverage dispenser, for applying an iced coating to the exterior of a serving cup for the post-mix beverage.

26 Claims, 7 Drawing Sheets

APPARATUS FOR ICING A PACKAGE

BACKGROUND OF THE INVENTION

The present invention relates to a system for applying a coating of ice to the outside of a container for packaged beverages. More specifically, the present invention relates to a system integrally disposed within the interior of the cabinet of a vending machine to enable the machine to deliver frosted packaged beverages to consumers; or to a stand-alone container frosting assembly which may be located next to a post-mix beverage dispenser for applying ice to the exterior of a cup after filling.

Putting ice on the outside of a cup or package reinforces the consumer's perception of a refreshing cold product. This is particularly important with plastic bottles or cans which because of the low coefficient of heat transfer of the plastic the container doesn't feel as cold as a conventional metal or glass container. Therefore, to be able to sell an ice covered package creates an advantage over packages that are un-iced in vending and post-mix applications since the presence of ice or frosting increases the perception of coolness due to both the visual and feel characteristics of the coating of ice.

It would be highly desirable to be able to provide a system which has this capability of icing the outside of packaged beverages which can fit wholly within a vending machine and preferably within the door assembly thereof. Such a compact system could be retrofit into existing vending machines in order to provide the ability to vend ice covered packaged beverages.

SUMMARY OF THE INVENTION

Accordingly, it is a primary object of the present invention to provide a system for applying ice to the outside of a container for a packaged beverage which increases the perception of coldness and refreshability of the product to the customer.

It is another object of the present invention to provide a system for providing a frosted coating on the outside of a packaged beverage container so that the beverage looks colder to a potential consumer.

It is a further object of the present invention to provide a system which can coat the exterior surfaces of plastic cans, bottles or the like in order to make such containers feel colder to the consumer.

It is yet another object of the present invention to provide a compact handling and refrigerating mechanism for the system of the present invention which fits wholly within the door of a conventional vending machine so that the system may be retrofit into existing machines in the field.

It is still another object of the present invention to provide a handling mechanism for the icing system of the present invention which provides a delivery port through the face of a vending machine at essentially eye level to improve the convenience, visibility and accessibility of the packaged beverage to the customer.

These and other objects of the present invention are fulfilled by providing an apparatus for vending packaged beverages with frosted coatings of ice on exterior surfaces thereof comprising:

a cabinet for storing a supply of the packaged beverages to be rended, said cabinet having a front face with a delivery port therein through which the packaged beverages are vended;

spray means for applying a mist of freezable liquid to the exterior surfaces of the packaged beverages; and refrigeration means for freezing the liquid on the exterior surfaces to form a frosted coating of ice thereon.

The packaged beverage such as a soft drink can to be vended is supported on a movable platform and a conveyor means moves the platform seriatim to the spray means, refrigeration means and delivery port in the face of the vending machine.

A gravity feed arrangement selectively supplies the beverage cans to the platform from an appropriate product storage column into a can orienting funnel. The conveyor means then moves the can on the platform in succession past the spray means, refrigeration means and to the delivery port.

The refrigeration means includes a housing defining a plenum for the distribution of refrigerant about the exterior of the packaged beverage, a through passage for accommodating the movement of the packaged beverages through the plenum and a refrigerant input port to the plenum; and an injector coupled to the input port for supplying the refrigerant to the plenum.

In one embodiment the refrigerant utilized and supplied to the plenum is compressed air injected through a vortex type injector which chills the air to the necessary temperature in order to freeze the mist (water droplets) that has been sprayed on the exterior of the packaged beverage.

In another embodiment the refrigerant is liquid $CO_2$ which is supplied to the plenum and sprayed onto the exterior of the packaged beverage container. In this embodiment the liquid $CO_2$ may be supplied from a container disposed outside of the cabinet of the vending machine, and is connected to the injector and the plenum by a suitable hose.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
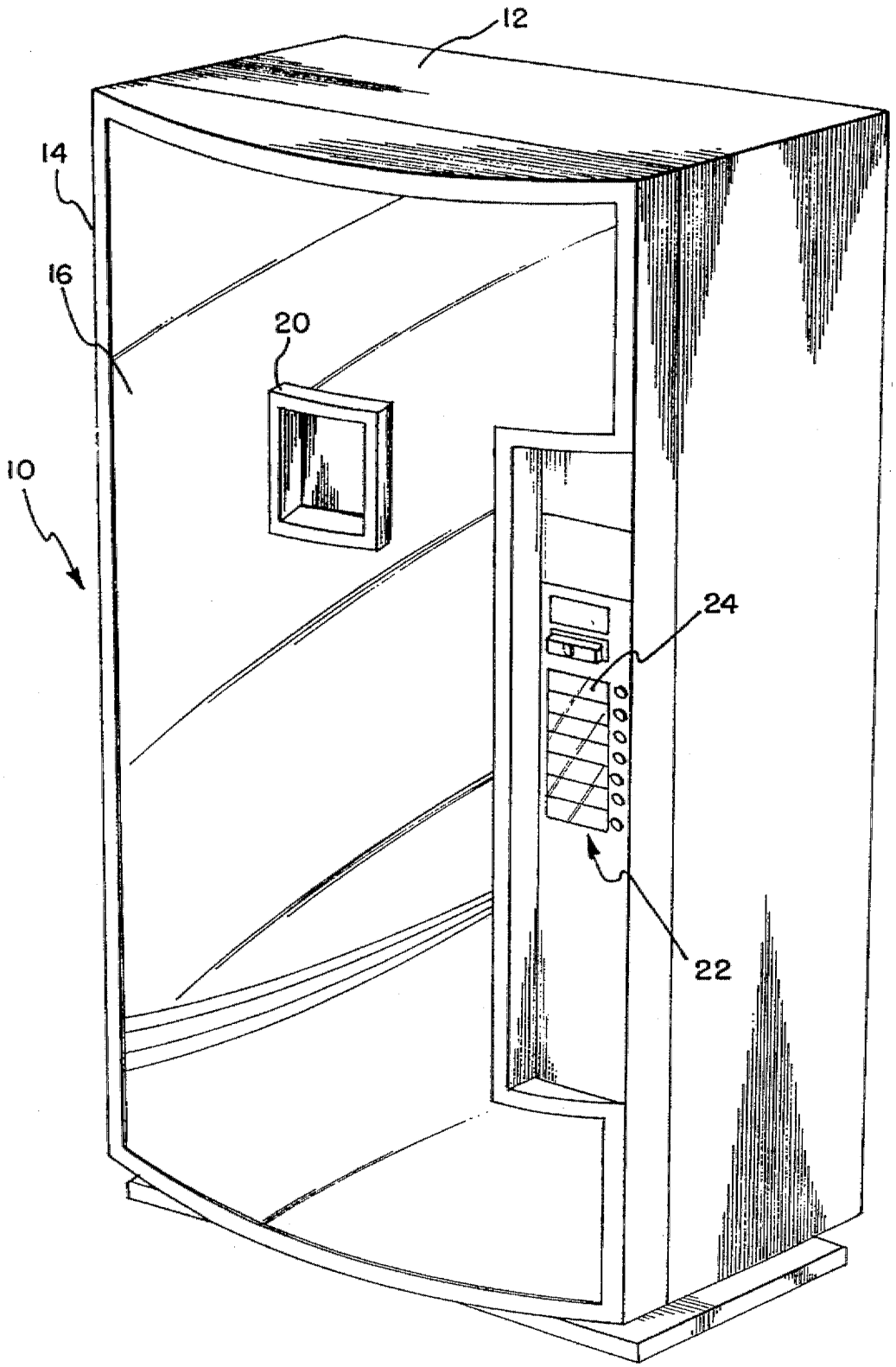
FIG. 1 is a right-front perspective view of a vending machine cabinet suitable for use with the package icing system of the present invention.

FIG. 1 is a right front perspective view depicting a vending machine 10 including a cabinet 12, a door 14 and a sign panel 16 thereon. The door and sign panel are bowed, providing a convex exterior surface for a sign panel, and a concave interior space for accommodating various equipment such as the package icing system of the present invention.

The vending machine 10 also includes a product selection panel 22 and a plurality of product selection buttons 24. A delivery port 20 with a moveable transparent cover 21 thereacross is provided through the face of the sign panel 16. In a preferred embodiment the delivery port 20 is preferably at essentially eye level near the top of the control panel 22 to make the iced product more readily visible and convenient to a consumer utilizing the machine. The cover 21 is preferably hinged at the top permitting it to be flipped up to provide access to the rended product presented to the port 20. In the alternative, cover 21 could be slidable in tracts or grooves.

Figure 2:
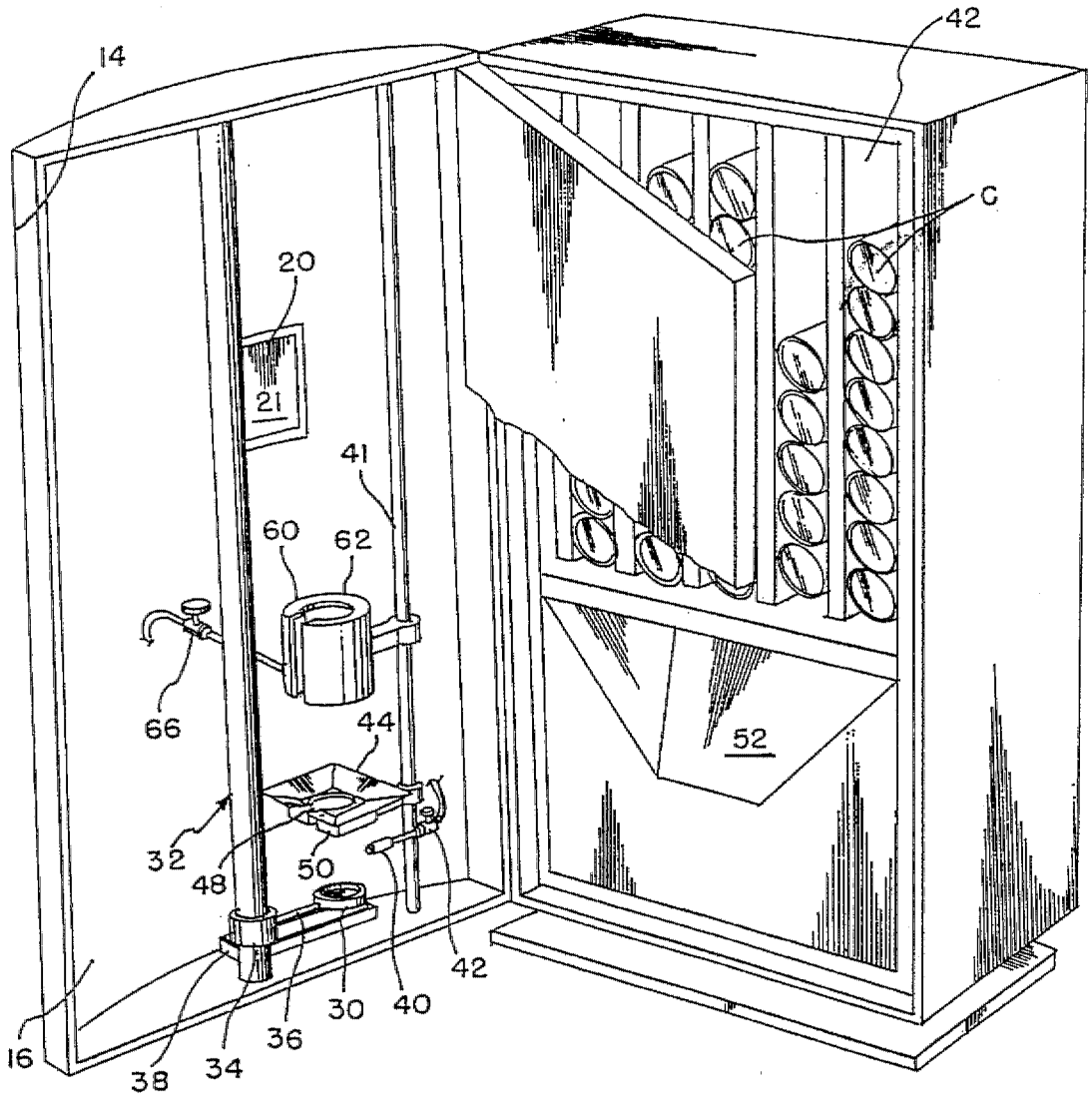
FIG. 2 is a rear perspective view of the vending machine cabinet of FIG. 1 with the front door thereof opened, illustrating the manner in which the icing system of the present invention is mounted within the door, and the arrangement of the product columns in the adjacent housing of the vending machine.

FIG. 2 which is a perspective view of the rear side of the door 14 of the vending machine 10 of FIG. 1 and the inside of the cabinet portion 12. It can be seen as depicted in FIG. 2 how the various components of the icing system to be described hereinafter fit within the confines of the cavity provided by the bowed front panel 16 of the door assembly 14. Also illustrated in FIG. 2 is the manner in which a plurality of columns 42 of vendable products such as beverage cans C are disposed in the housing of the cabinet for selective gravity feed through the vend chute 52 to the can orientation funnel 44 to be described further hereinafter. Each column 42 communicates through a vend gate (not shown) at the bottom thereof with funnel 52. The vend gates open and close as directed by selection buttons 24.

Figure 3:
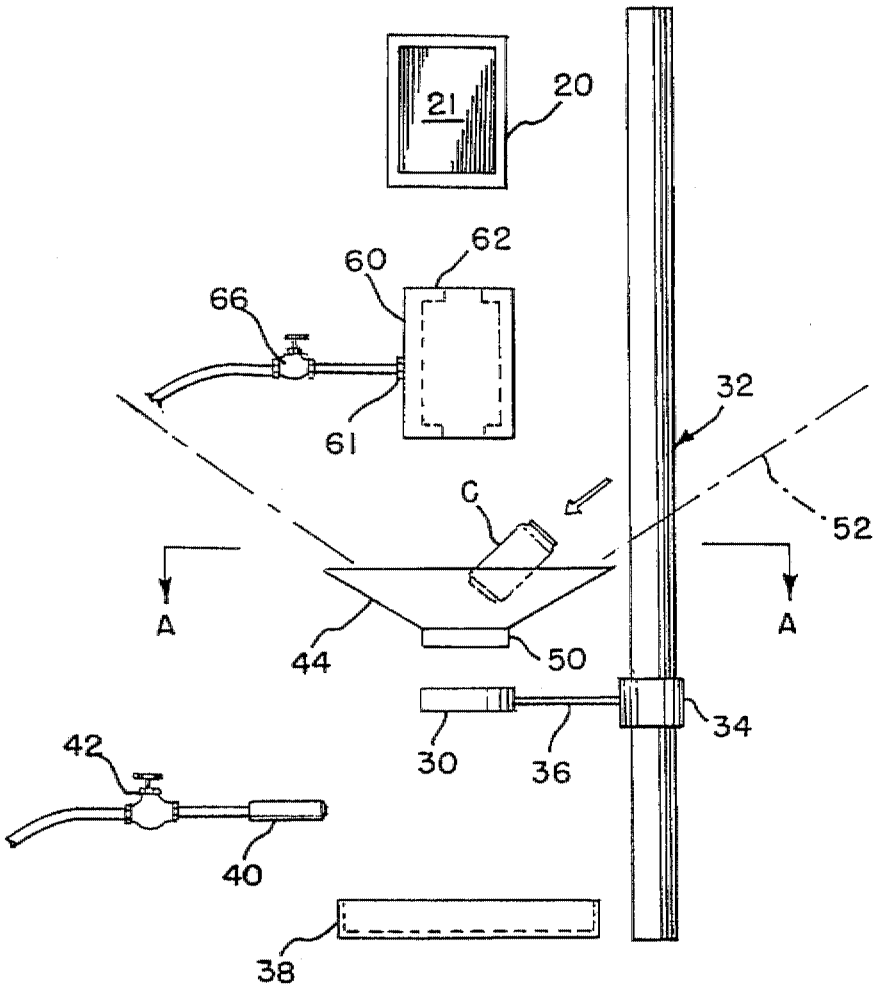
FIG. 3 is a, diagrammatic, elevational view of the system components mounted in the door of the vending machine of FIGS. 1 and 2 illustrating a first position of operation in which a can is falling for orientation upon the can supporting platform.
Figure 3A:
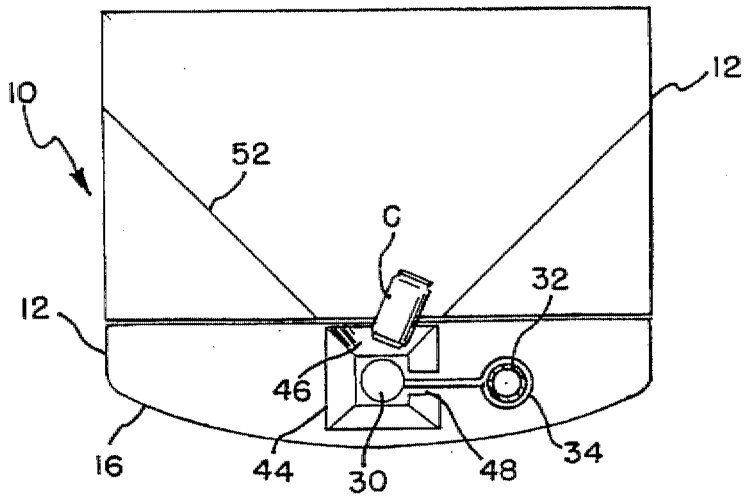
FIG. 3A is a cross-section taken along line A—A of FIG. 3.

FIGS. 3 to 6 collectively illustrate the operation of the icing system of the present invention and the movement of a beverage can C therethrough in four successive positions. Referring in more detail to FIG. 3 by way of example there is illustrated the components of the icing system of the present invention including a can supporting platform 30 supported on a movable arm 36 coupled to a follower element 34 on a linear actuator or elevator 32. Linear actuator 32 may be a rodless air cylinder, a screw-type rod with a threaded follower, a ball reverser or any other suitable type of linear actuator of compact construction. Follower 34 is mounted for movement vertically of the actuator 32 to impart the vertical movement to the platform 30 through the various positions and components of the icing system.

In addition to the platform 30 there is provided a can orientation funnel 44 for receiving a can C from a vend chute 52 within the cabinet section 12 of the machine. The can orientation funnel 44 has slanted sidewalls 46 sloping down from an upper open end thereof to a bottom sleeve 50 with a bottom opening in alignment with the top of can supporting platform 30. A slot 48 is provided through funnel and sleeve 50 to accommodate movement of support arm 36 therethrough.

Disposed just below the platform 30 in FIG. 3 is a spray nozzle 40 supported on rod 41 (see FIG. 2) connected to a water supply conduit and associated control valve 42 for providing a mist or spray of water droplets to the exterior of a can. For simplicity only one nozzle 40 is illustrated in FIGS. 3 to 6. However, it should be understood that a plurality of nozzles 40 may be provided around the exterior of a container C to be presented to the nozzles 40 by the platform 30.

A refrigeration assembly is disposed above the can orientation funnel 44 in vertical alignment therewith. The refrigeration assembly includes a cylindrical sleeve 60 supported on rod 41 of FIG. 2 having an annular plenum 62 defined therein. A through passage is provided through the sleeve 60 by open top and bottom ends of the cylindrical structure. An input coupling 61 communicates with the plenum 62 adjacent a control valve 66. In a preferred embodiment liquid $CO_2$ is supplied through a hose to control valve 66 and the input coupling 61 to the plenum 62.

Disposed just above the refrigeration assembly is the delivery port 20 in the face of the sign panel 16. As described hereinbefore the delivery port 20 is provided with a manually moveable transparent cover or door 21 hinged at the upper corners so that it may be flipped up to provide access to a chilled beverage can once it is presented to the deliver port location.

DESCRIPTION OF OPERATION

The operation of the icing system of the present invention may be readily understood by reference to FIGS. 3 to 6 of the drawings.

Figure 4:
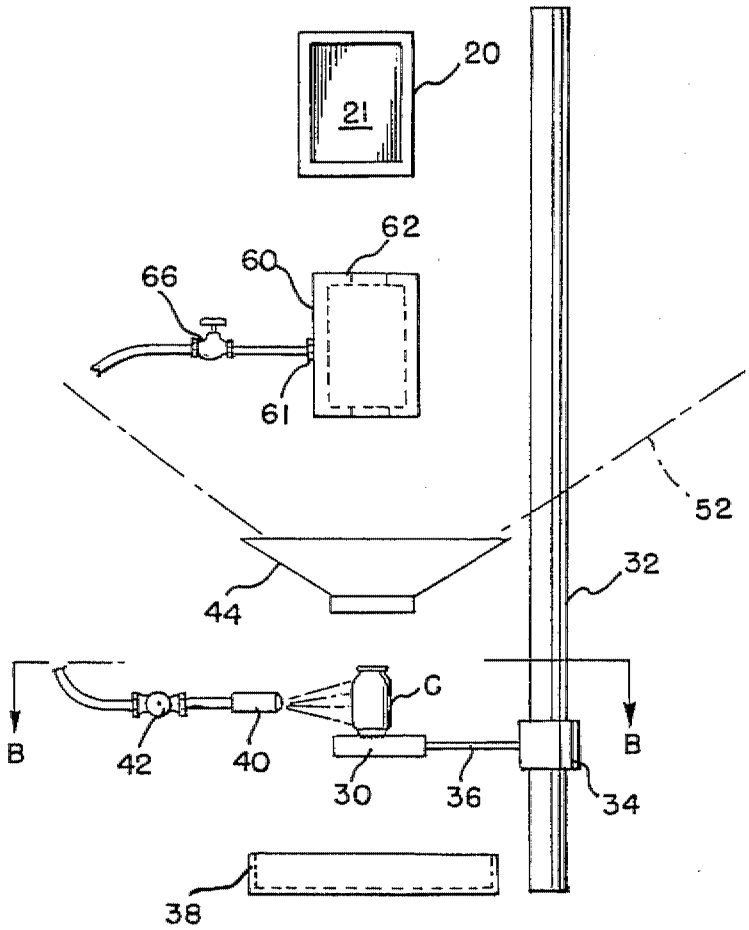
FIGS. 4 and 4A are similar illustrations to those of FIGS. 3 and 3A showing a second position in which the can is disposed on the platform in alignment with the water spraying mechanism of the present invention.
Figure 4A:
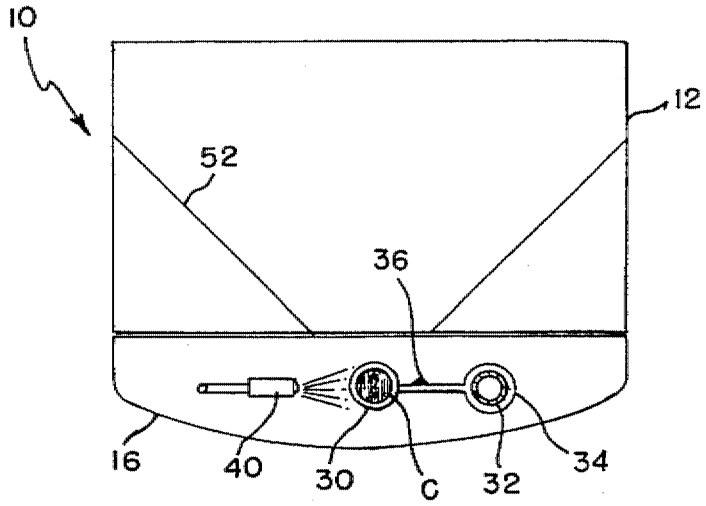

In FIG. 3, the beginning of the icing process is illustrated wherein a can C is fed through vend chute 52 into the can orientation funnel 44 en route to the can supporting platform 30. As illustrated in FIG. 4, once the can C is properly oriented upon the can platform 30, the platform 30 moves down into alignment with the spray nozzle(s) 40 and the control valve 42 is opened causing a mist or spray of water droplets to be applied to the outside surface of the can C.

Figure 5:
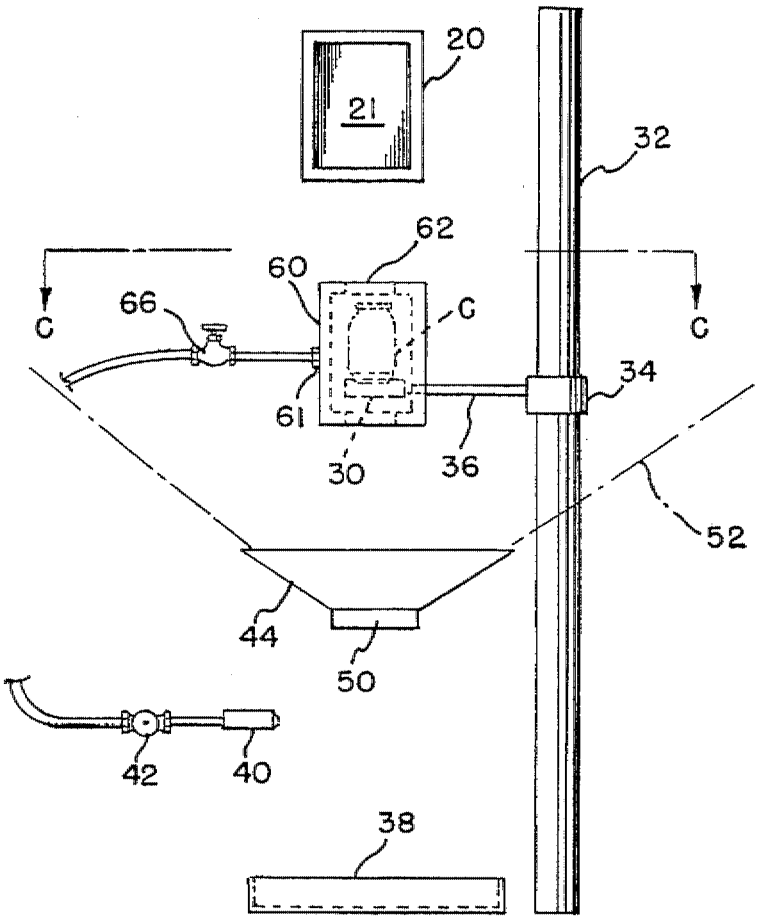
FIGS. 5 and 5A are similar illustrations of the operation of the icing mechanism showing a third position in which the can is disposed within the freezing tube of the present invention for applying an ice coating thereto.
Figure 5A:
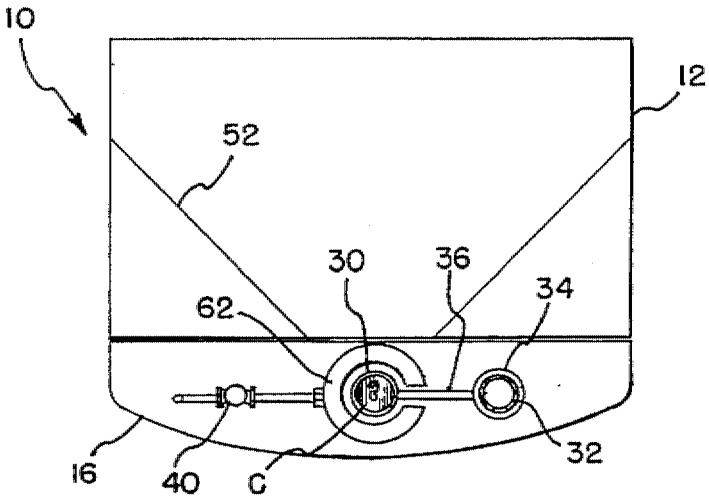

As illustrated in FIG. 5 the platform 30 is then elevated vertically up through can orientation funnel 44 until the can and associated platform arrive within freeze tube or sleeve 60 for the application of liquid $CO_2$ to the exterior surface thereof in order to freeze the water already applied to the exterior of the can. As illustrated in FIG. 5A a slot 64 is provided in sleeve 60 to permit the bracket or arm 36 which supports platform 30 to pass therethrough.

Figure 6:
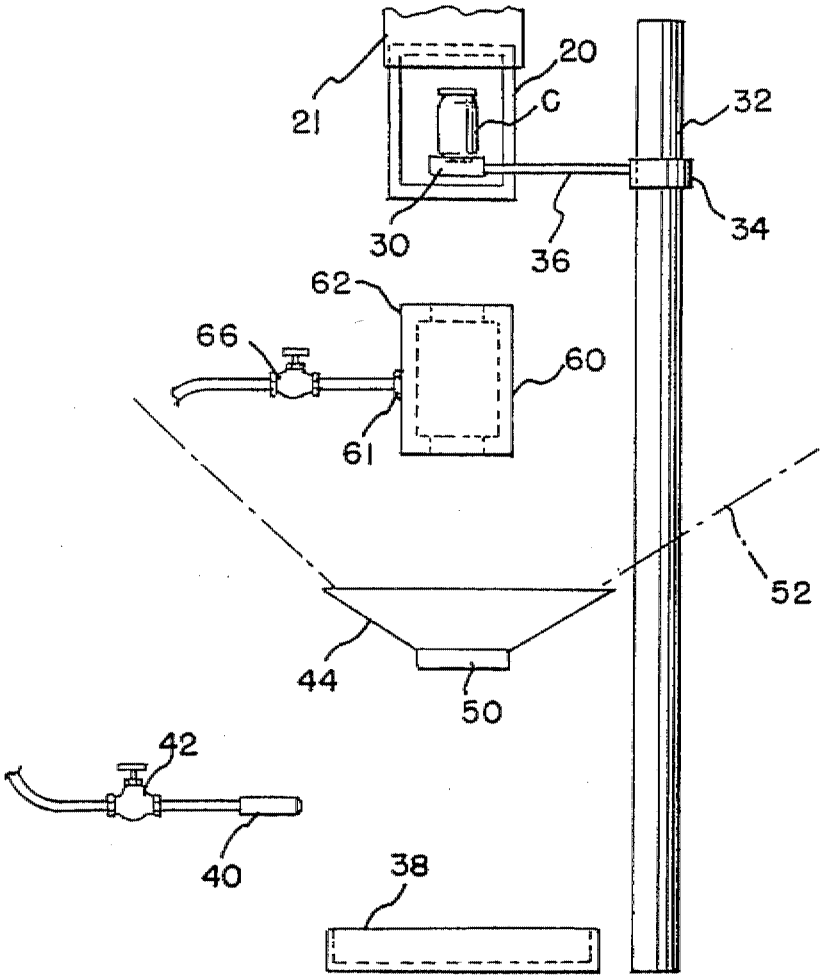
FIGS. 6 and 6A are similar diagrammatic illustrations of a fourth position of the can in the icing system of the present invention wherein it is presented for retrieval by the customer at the vend port in the face of the vending machine.
Figure 6A:
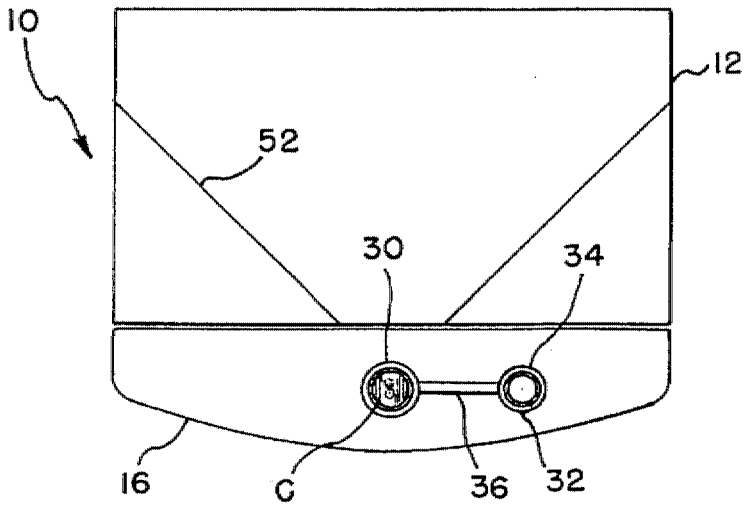

Once the ice is formed on the can in the position illustrated in FIG. 5 the can moves onto the position illustrated in FIG. 6 wherein it is presented for retrieval by the customer at the deliver port 20. As illustrated in FIG. 6 the cover 21 at this point is flipped up about its hinges providing access to the can by the customer.

Accordingly, the icing system of the present invention provides a compact can handling assembly which fits wholly within the front door of a conventional vending machine and operates in conjunction with the can selection and gravity feed vend chutes in the main cabinet of the vending machine in order to deliver a packaged beverage with an iced or frosted coating to deliver port 20 for access by a customer.

Figure 7A:
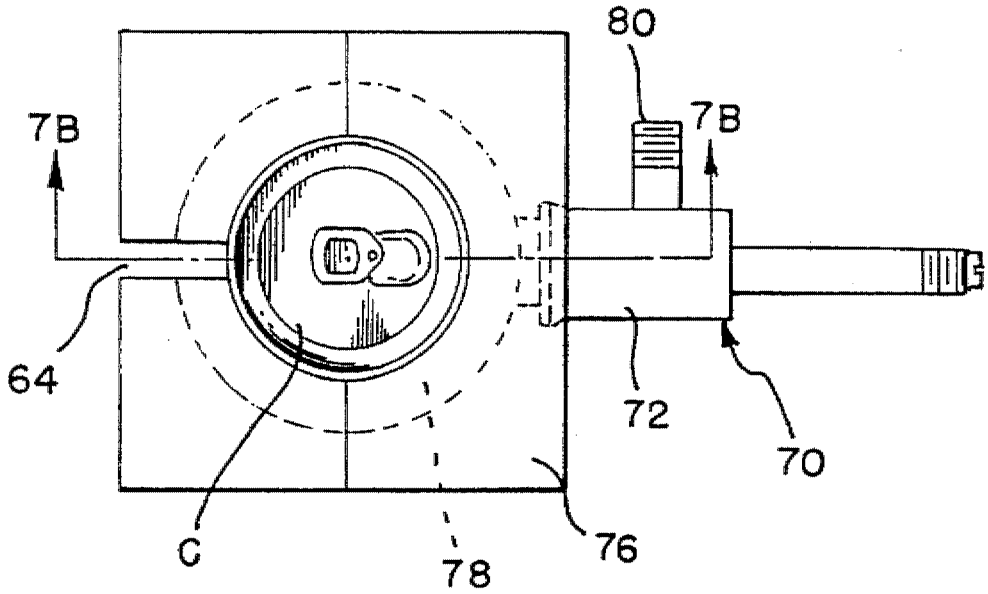
FIG. 7A is a top plan view of an alternative embodiment of a refrigeration assembly of the present invention using a vortex injector.
Figure 7B:
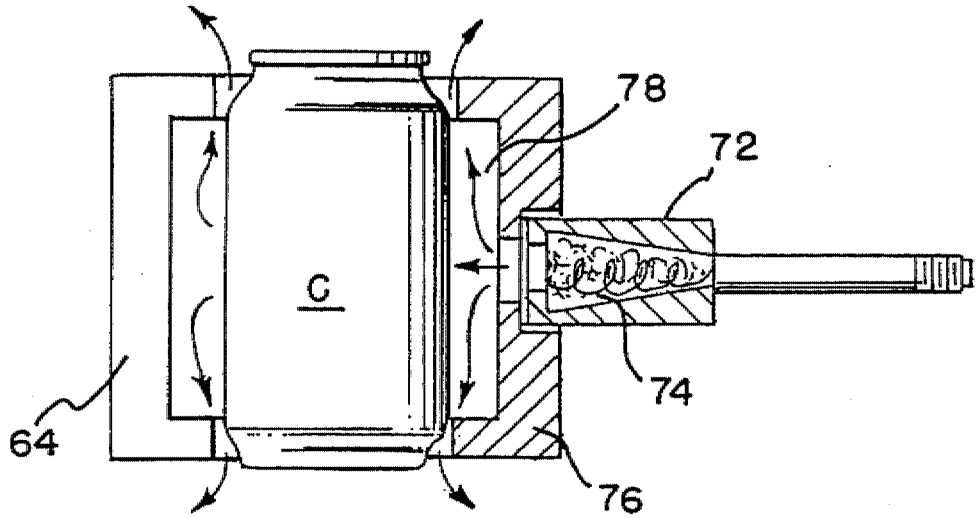
FIG. 7B is a cross-section taken along line B—B of FIG. 7A.

In the embodiment illustrated in FIGS. 3 to 6 the refrigeration unit utilizes liquid $CO_2$ in order to freeze the water mist sprayed onto the beverage can. An alternative embodiment for freezing the water mist is illustrated in FIGS. 7A and 7B. This embodiment utilizes a vortex tube type of refrigerator device 70. As illustrated the device 70 includes a tube 72 with a conical vortex chamber 74 coupled through an input fitting in the sidewall of-a split housing 76 defining an interior plenum 78. Vortex cooling devices of the type illustrates as 70 in this embodiment are well known and operate such that compressed air, for example, supplied through an input coupling 80 to the conical vortex chamber is swirled creating the net effect of substantially cooling the compressed air output into the plenum to create a refrigerated gas of a sufficiently low temperature to freeze any water or mist applied to the exterior of the can C. The refrigeration unit depicted in FIGS. 7A and 7B may be utilized in the vending machine cabinet 10 described hereinbefore; or may be part of a stand-alone container icing system utilized adjacent to a post-mix beverage dispenser for icing cups of beverages after they have been filled with appropriate beverages.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for vending packaged beverages with frosted coatings of ice on exterior surfaces of the rended package comprising:

a cabinet for storing a supply of the packaged beverages to be rended, said cabinet having a front face with a delivery port therein through which the packaged beverages are rended;

spray means for applying a mist of freezable liquid to the exterior surfaces of the packaged beverages; and refrigeration means for freezing the liquid on the exterior surfaces to form a frosted coating of ice thereon.

2. The apparatus of claim 1 further including transport means for moving packaged beverages seriatim to said spray means, refrigeration means and delivery port.

3. The apparatus of claim 2 wherein said transport means comprises:

a movable platform for supporting a packaged beverage thereon; and conveyor means for moving the platform seriatim to the spray means, refrigeration means and delivery port.

4. The apparatus of claim 3 said transport means further including:

feed means for moving the packaged beverages one at a time to said platform from said supply; and means for vertically orienting the packaged beverages on the platform.

5. The apparatus of claim 4 wherein said feed means comprises gravity feed chutes, and the means for orienting comprises a funnel having a larger open, input, end aligned with the chutes and a smaller open, discharge, end aligned with the platform.

6. The apparatus of claim 1 wherein the spray means and refrigeration means are wholly contained within a door on the front of the cabinet.

7. The apparatus of claim 6 wherein the door has a bowed front.

8. The apparatus of claim 1 wherein the packaged beverages are cans of beverages.

9. The apparatus of claim 1 wherein the packaged beverages are cups of beverages.

10. The apparatus of claim 1 wherein the packaged beverages are bottles of beverages.

11. The apparatus of claim 1 wherein the packaged beverages are plastic containers filled with beverages.

12. The apparatus of claim 1 wherein the delivery port, spray means and refrigeration means are vertically spaced with the delivery port at the highest location.

13. The apparatus of claim 1 wherein said refrigeration means comprises: a housing defining a plenum for distribution of refrigerant about the exterior of the packaged beverage, a through passage for accommodating the movement of the packaged beverages through the plenum and a refrigerant input port to the plenum; and an injector coupled to the input port for supplying refrigerant to the plenum.

14. The apparatus of claim 13 wherein the refrigerant is compressed air and the injector is a vortex injector for chilling the air.

15. The apparatus of claim 13 wherein the refrigerant is liquid $CO_2$.

16. The apparatus of claim 15 wherein the liquid $CO_2$ is supplied from a container disposed outside of the cabinet and a conduit coupled between the injector and the container.

17. The apparatus of claim 3 wherein said refrigeration means comprises: a housing defining a plenum for distribution of refrigerant about the exterior of the packaged beverage, a through passage for accommodating the movement of the packaged beverages through the plenum and a refrigerant input port to the plenum; and an injector coupled to the input port for supplying refrigerant to the plenum.

18. The apparatus of claim 17 wherein the refrigerant is compressed air and the injector is a vortex injector for chilling the air.

19. The apparatus of claim 17 wherein the refrigerant is liquid $CO_2$.

20. The apparatus of claim 19 wherein the liquid $CO_2$ is supplied from a container dispensed outside of the cabinet and a conduit coupled between the injector and the container.

21. The apparatus of claim 17 wherein the through passage is large enough to accommodate the movement of the platform therethrough.

22. Apparatus for applying frosted coatings of ice on exterior surfaces of packaged beverages comprising:

spray means for applying a mist of freezable liquid onto the exterior Surfaces of the packaged beverages;

refrigeration means for freezing the liquid on the exterior surfaces to for a frosted coating of ice thereon;

a moveable platform for supporting a packaged beverage thereon; and conveyor means for moving the platform seriatim to the spray means and refrigeration means.

23. The apparatus of claim 22 wherein said refrigeration means comprises: a housing defining a plenum for distribution of refrigerant about the exterior of the packaged beverage, a through passage for accommodating the movement of the packaged beverages through the plenum and a refrigerant input port to the plenum; and an injector coupled to the input port for supplying refrigerant to the plenum.

24. The apparatus of claim 22 wherein the refrigerant is compressed air and the injector is a vortex injector for chilling the air.

25. The apparatus of claim 22 wherein the refrigerant is liquid $CO_2$.

26. The apparatus of claim 22 wherein the thorough passage is large enough to accommodate the movement of the platform therethrough.

* * * * *